US008678110B2

(12) United States Patent
Cenac

(10) Patent No.: US 8,678,110 B2
(45) Date of Patent: Mar. 25, 2014

(54) MUD SAVER VALVE AND METHOD OF OPERATION OF SAME

(75) Inventor: Martin Cenac, Lafayette, LA (US)

(73) Assignee: Blowout Tools, Inc., Houston, TX (US)

( * ) Notice: Subject to any disclaimer, the term of this patent is extended or adjusted under 35 U.S.C. 154(b) by 337 days.

(21) Appl. No.: 13/077,053

(22) Filed: Mar. 31, 2011

(65) Prior Publication Data

US 2011/0240300 A1 Oct. 6, 2011

Related U.S. Application Data

(60) Provisional application No. 61/320,037, filed on Apr. 1, 2010.

(51) Int. Cl.
*E21B 21/10* (2006.01)

(52) U.S. Cl.
CPC ..... *E21B 21/10* (2013.01)
USPC ..... 175/318; 166/321; 166/319

(58) Field of Classification Search
USPC ..... 175/318; 166/321, 319; 137/496, 81.1; 251/336
See application file for complete search history.

(56) References Cited

U.S. PATENT DOCUMENTS

| | | | | |
|---|---|---|---|---|
| 6,053,191 | A | 4/2000 | Hussey | |
| 6,640,824 | B2 | 11/2003 | Majkovic | |
| 6,662,886 | B2 | 12/2003 | Russell | |
| 6,732,819 | B2 * | 5/2004 | Wenzel | 175/218 |
| 7,048,079 | B1 | 5/2006 | Parker | |
| 2001/0037900 | A1 | 11/2001 | Majkovic | |
| 2003/0102131 | A1 | 6/2003 | Wenzel | |
| 2005/0189144 | A1 | 9/2005 | Williford | |
| 2005/0236191 | A1 | 10/2005 | Hu | |
| 2007/0039759 | A1 | 2/2007 | Foley | |

* cited by examiner

*Primary Examiner* — Cathleen Hutchins
(74) *Attorney, Agent, or Firm* — Garvey, Smith, Nehrbass & North, L.L.C.; Gregory C. Smith; Julia M. FitzPatrick

(57) ABSTRACT

A mud saver valve, positionable at the bottom of the drill string, above the bit, which includes an elongated body portion; portion of the valve housing a compressible spring a pressure; a valve mechanism which is a sliding sleeve moveable between open and closed positions within the valve; while in the closed position, drilling fluid cannot pass through the valve; when a combination of static and pump pressure exceeds the setting pressure of the dome, the sleeve will be moved by actuation pistons to the open position, at which drilling fluid is allowed to through the valve. Also, wherein when the valve is normally closed, as long as the fluid column pressure is less than the setting pressure, the valve remains closed, and allows the drill string to be disconnected and a section of pipe can added without the fluid draining from the drill column above the bit, and thus saving fluid.

8 Claims, 19 Drawing Sheets

MUD SAVER VALVE AND METHOD OF OPERATION OF SAME

CROSS-REFERENCE TO RELATED APPLICATIONS

Priority of U.S. Provisional Patent Application Ser. No. 61/320,037, filed 1 Apr. 2010, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oilfield valves. More particularly, the present invention relates to a mud saver valve when installed to prevent the loss of drill fluid during starting operation in deep water wells using a combination of static fluid pressure and flow pressure to open the valve and mechanical spring forces to close the valve.

2. General Background of the Invention

When drill pipe and other tubular strings are lowered into or raised out of a well bore, including, but not limited to, during the drilling of the wellbore, it is quite common, particularly in the oil and gas field, for the drill pipe and other tubular strings to be filled with mud of the type used in drilling techniques. The mud would typically be pumped into the upper end of the drill string after it has been connected to the drill string below it and/or as it is being lowered into a wellbore. As the next joint is added to the drill string, the connection is typically disconnected from the drill string to allow the next section of drill pipe to be connected to the string. When the fluid connection is disconnected, there should preferably to be a mud saver valve in place to retain this fluid and prevent it from flowing out onto the work area and environment. The advantages of using such a valve are well known and include saved mud cost, decreased chances of pollution, and increased safety to rig personnel. To avoid this loss of mud during these types of operations there is needed a mud saver valve which could be positionable just above the drilling bit or just below the bend sub to prevent the loss of drill fluid during starting operation in deep water wells, which reduces the amount of drilling fluid required to start a well and reduces the pollution of the mud bottom with drilling fluid and weighting material.

This invention replaces the original Mud Saver Valve, as disclosed U.S. patent application Ser. No. 12/652,547, noted above, which utilized a pre charged nitrogen dome chamber to feed pre charge pressure to the closing side of multiple pistons that are arranged in an equally spaced circular pattern around the center axis of the valve. The force created by the pre charge pressure acting on the multiple pistons force a slidable sleeve to close the fluid pathway through the valve.

To force the original Mud Saver Valve to open its fluid pathway through the valve, pressure inside the drill pipe at the valve's location in the well bore has to rise above the pre charge pressure of the nitrogen dome plus whatever pressure is required to overcome the friction force of the piston seals. To accomplish this either direct hydrostatic head pressure or the combination of direct hydrostatic head pressure and flow pressure generated by the mud pumps are required.

With the original Mud Saver Valve the amount of pump pressure required to open the valve is a function of the depth of the tool in the well bore. The deeper the tool, the higher the hydrostatic head pressure and the lower the pump pressure required to open the valve.

With the original Mud Saver Valve the valve could be set to open at any particular depth by adjusting the nitrogen pre charge pressure prior to entering the well bore.

The following U.S. patents are incorporated herein by reference:

TABLE

| U.S. Pat. No./ Publication No. | TITLE | ISSUE DATE DD-MM-YYYY |
|---|---|---|
| 20030102131 | Mudsaver Valve with retrievable inner sleeve. | 06-05-2003 |
| 20050189144 | Mud Saver Valve | 09-02-2005 |
| 20050236191 | Drill String Valve Assembly | 10-27-2005 |
| 20010037900 | Mud Saver Kelly Valve | 11-08-2001 |
| 20070039759 | Mud Saver Valve | 02-22-2007 |
| 7,048,079 | Mud Saver Valve | 05-23-2006 |
| 6,053,191 | Mud-Saver Valve | 04-25-2000 |
| 6,640,824 | Mud Saver Kelly Valve | 11-04-2003 |
| 6,662,886 | Mudsaver Valve with Dual Snap Action | 12-16-2003 |

BRIEF SUMMARY OF THE INVENTION

The mud saver valve of the present invention solves the problems in the art in a simple and straightforward manner.

In summary, the new Mud Saver Valve II replaces the nitrogen dome with a mechanical compression spring that is compressed during the valve assembly process to a certain pre load found in the original Mud Saver Valve discussed above. This mechanical spring pre load provides the closing force acting on the valve's Mud Saver Valve II also opens the closing side of the multiple pistons to the annulus pressure at the valve location depth in the well bore.

Further, as with the original Mud Saver Valve, the opening side of the multiple pistons are fed with the pressure in the drill pipe at the valve's location depth in the well bore.

Further, in a static condition without flow if the fluid mud in the annulus and the fluid mud in the drill pipe are the same weight per unit volume then (neglecting friction in the piston seals) the differential pressure working across the multiple actuator pistons is zero.

The new pump pressure required to open the new Mud Saver Valve II is no longer a function of the depth of the valve in the well bore. The pump pressure required to open the new Mud Saver Valve II, at any well bore depth, is only a function of the mechanical compression spring pre load and whatever pressure is required to overcome the friction of the piston seals.

In the new Mud Saver Valve II design the amount of friction of the piston seals can be dramatically reduced by converting to mechanical labyrinth type seal. Labyrinth seals have no physical contact between the sealing surfaces. As a consequence of this the friction of the seal is eliminated. However, a small amount of leakage will pass through the seal. The amount of fluid following through the valve can be 12 barrels per min. (504 gal./min (1908 Liters/min)). The small amount of leakage past the two (2) 0.625 inch (1.59 cm) diameter pistons is thought to be negligible.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
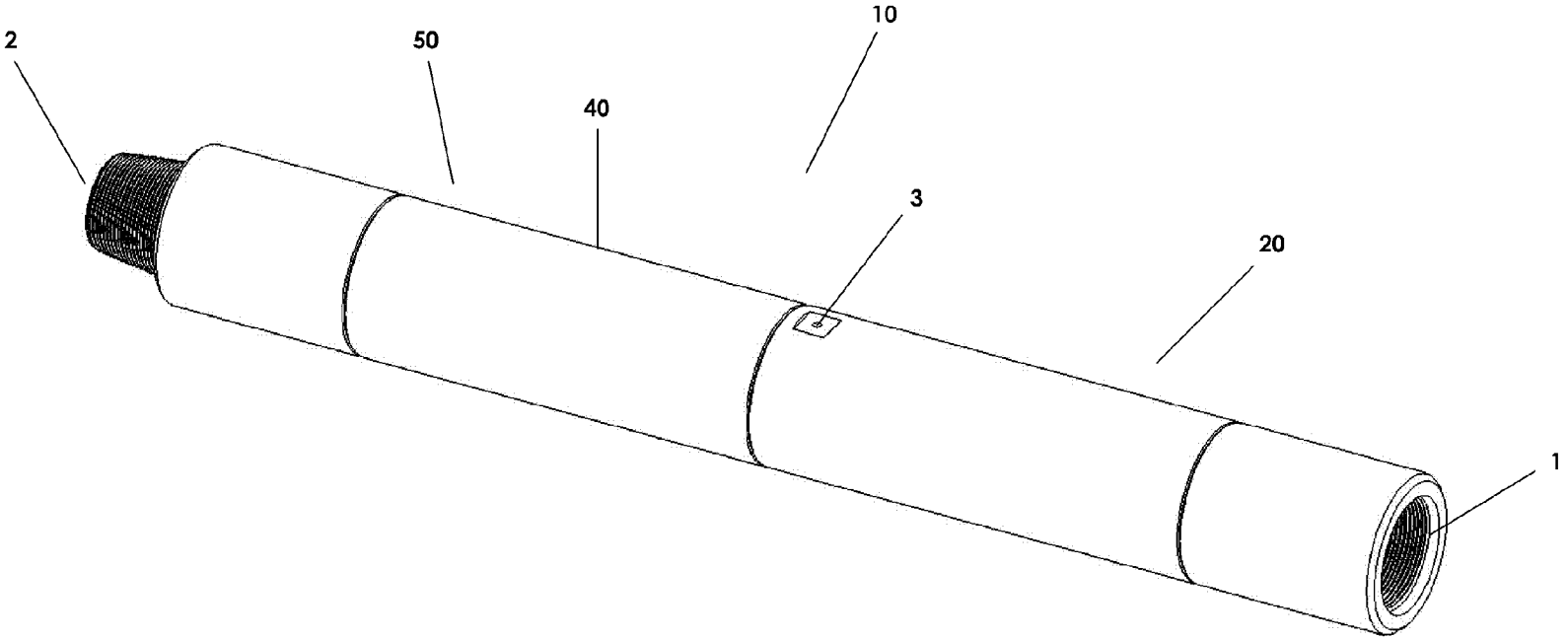
FIG. 1 is a trimetric view of the preferred embodiment of the apparatus of the present invention.
Figure 2:
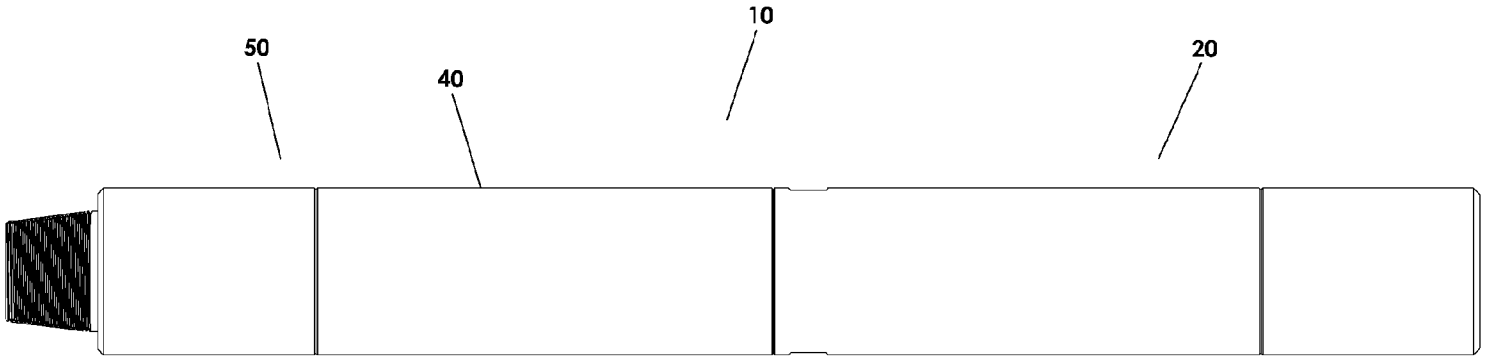
FIG. 2 is a front view of the preferred embodiment of the apparatus of the present invention.
Figure 3:
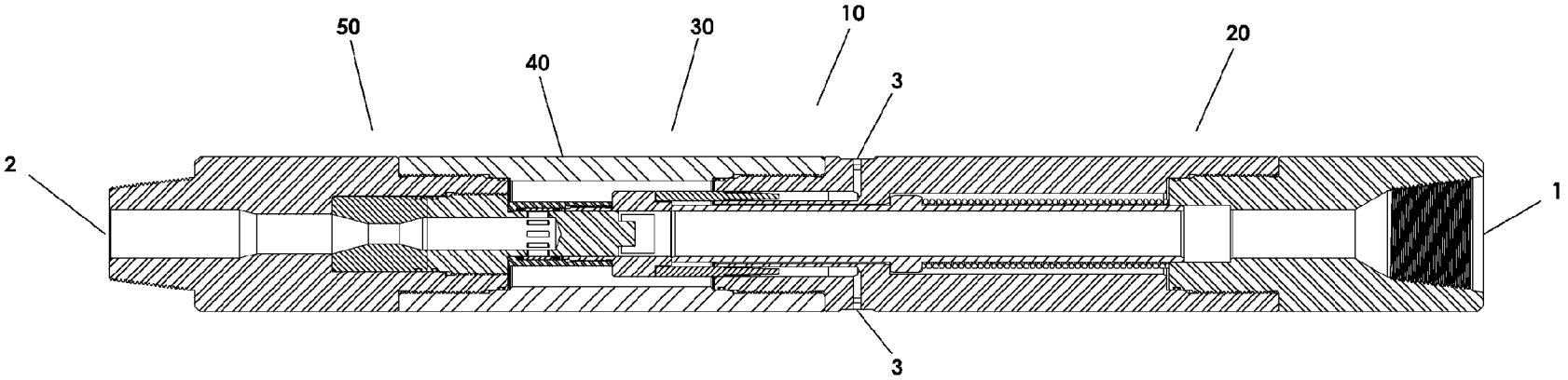
FIG. 3 is a front section view of the preferred embodiment of the apparatus of the present invention.
Figure 4:
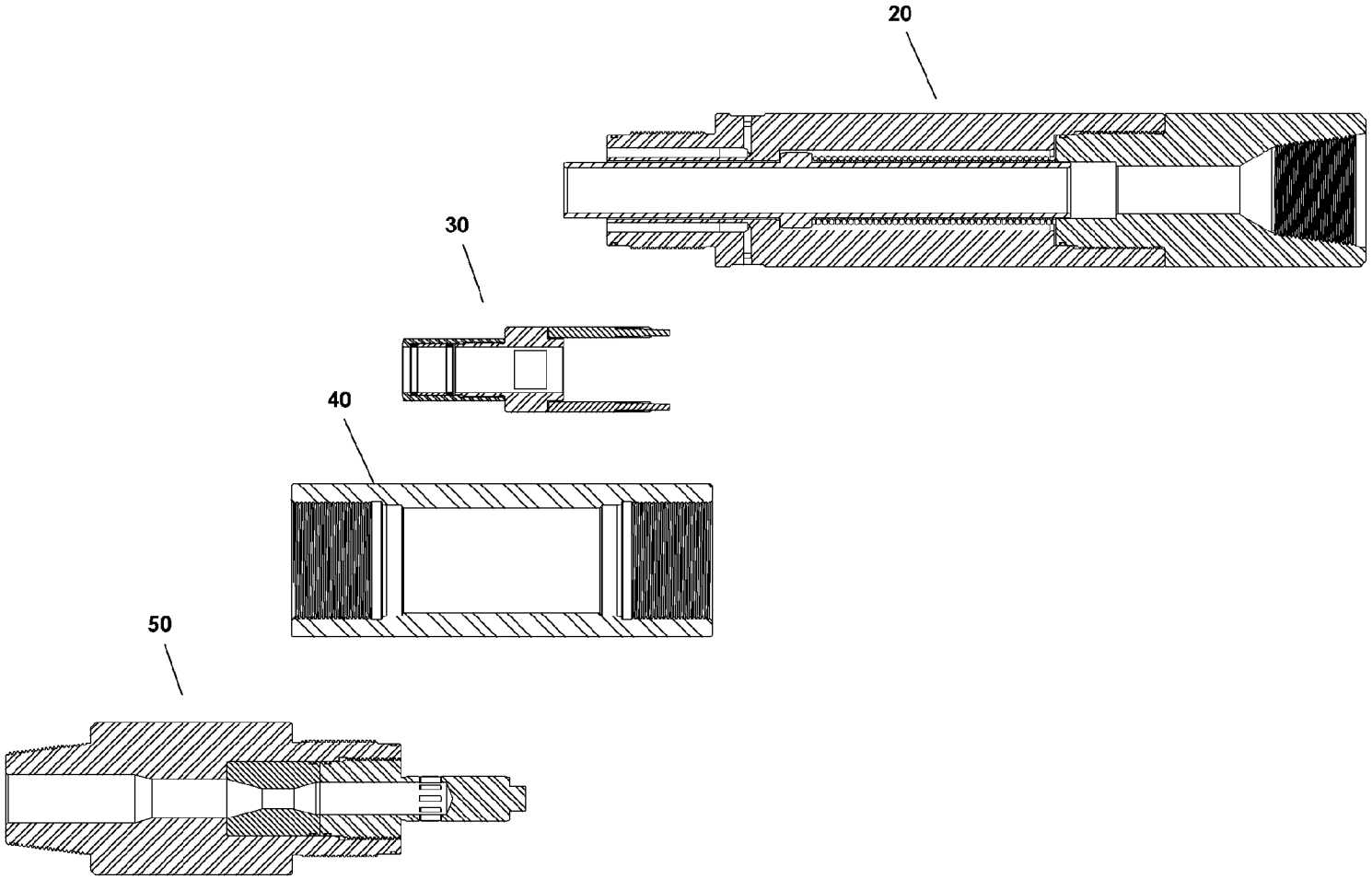
FIG. 4 is a front section view of the preferred embodiment of the apparatus of the present invention.
Figure 5:
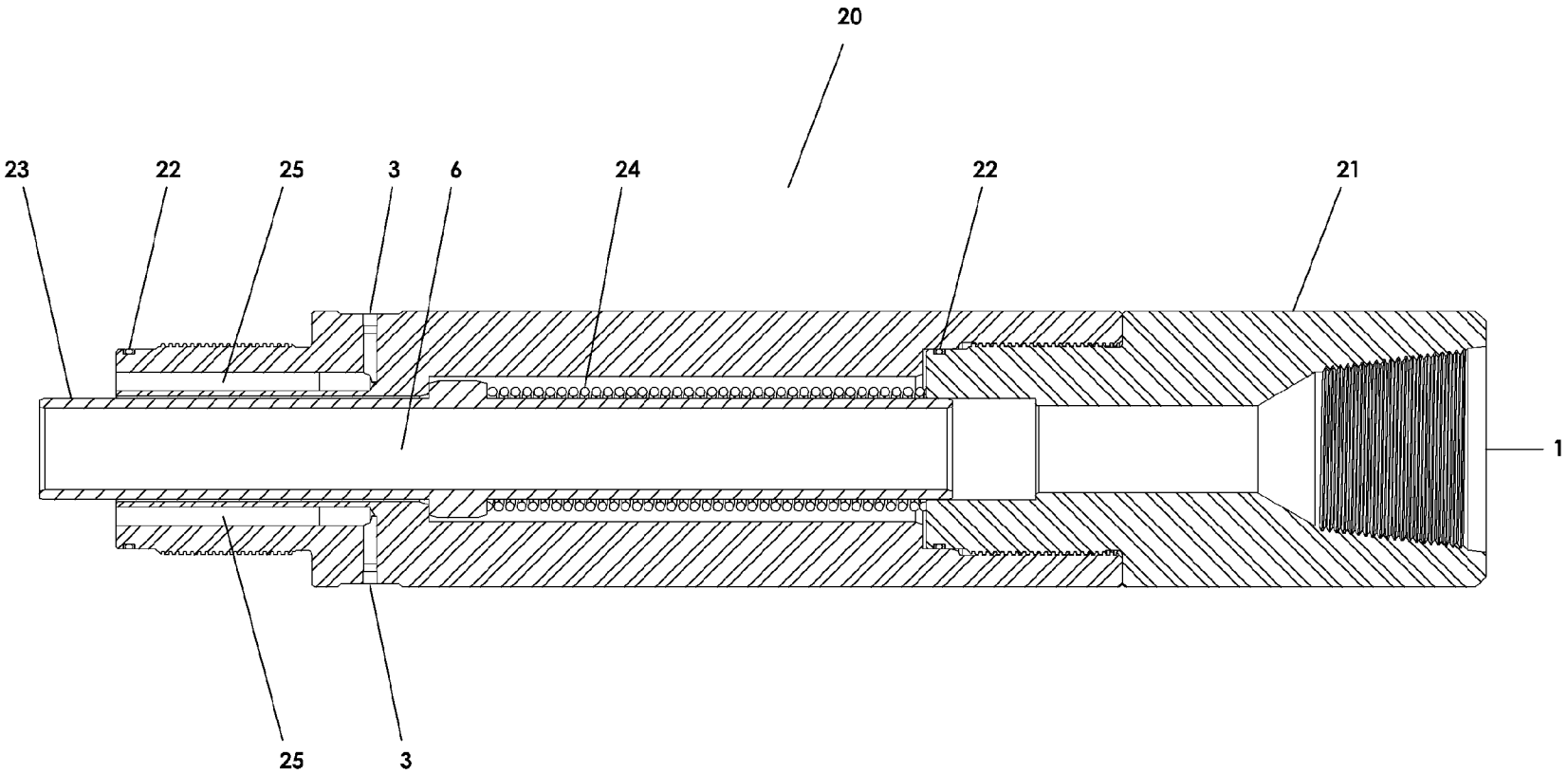
FIG. 5 is a front section view of the preferred embodiment of the apparatus of the present invention.

FIGS. 1 through 25 illustrate the embodiments of the Mud Saver Valve III of the present invention.

Prior to a discussion of the drawing figures, it should be kept in mind that the overall function of the Mud Saver Valve II and Mud Saver Valve with Concentric Pistons is the same as the original Mud Saver.

When the rig's mud pumps that circulate mud down the drill pipe to the drill bit at the bottom of the well bore and then return the mud, contaminated with drilled shavings, up the annulus to the BOP stack and finally either take the returning mud up the (subsea riser/spool) or (choke/kill lines) are off, a mechanical device in the original Mud Saver Valve and modified mechanical devices in the Mud Saver Valve II and Mud Saver Valve with Concentric Pistons force these valves to their closed positions and do not allow mud to flow through them.

When the rig's mud circulating pumps are turned on pressures working on respective mechanical devices in each of these three (3) Mud Saver Valve designs force the valves to open and allow the mud to flow through the valves.

The overall function of these valves is to capture the large volume of conditioned clean mud that is in the drill pipe from just above the drill bit at the bottom of the well bore up to the rig floor. These Mud Saver Valves will not allow the clean mud in the drill pipe to drain out of the bottom of the pipe and into the contaminated mud in the annulus as individual pipe stands are tripped in and out of the well bore.

The original Mud Saver Valve uses a pre charged nitrogen dome chamber to feed pre charge pressure to the closing side of multiple pistons that are arranged in an equally spaced circular pattern around the center axis of the valve. The force created by the pre charge pressure acting on the multiple pistons force a slidable sleeve to close the fluid pathway through the valve.

To force the original Mud Saver Valve to open its fluid pathway through the valve, pressure inside the drill pipe at the valve's location in the well bore has to rise above the pre charge pressure of the nitrogen dome plus whatever pressure is required to overcome the friction force of the piston seals. To accomplish this either direct hydrostatic head pressure or the combination of direct hydrostatic head pressure and flow pressure generated by the mud pumps are required.

With the original Mud Saver Valve the amount of pump pressure required to open the valve is a function of the depth of the tool in the well bore. The deeper the tool, the higher the hydrostatic head pressure and the lower the pump pressure required to open the valve.

With the original Mud Saver Valve the valve could be set to open at any particular depth by adjusting the nitrogen pre charge pressure prior to entering the well bore.

The new Mud Saver Valve II replaces the nitrogen dome with a mechanical compression spring that is compressed during the valve assembly process to a certain pre load. This mechanical spring pre load provides the closing force acting on the valve's Mud Saver Valve II also opens the closing side of the multiple pistons to the annulus pressure at the valve location depth in the well bore.

As with the original Mud Saver Valve, the opening side of the multiple pistons are fed with the pressure in the drill pipe at the valve's location depth in the well bore.

In a static condition without flow if the fluid mud in the annulus and the fluid mud in the drill pipe are the same weight per unit volume then (neglecting friction in the piston seals) the differential pressure working across the multiple actuator pistons is zero.

The new pump pressure required to open the new Mud Saver Valve II is no longer a function of the depth of the valve in the well bore. The pump pressure required to open the new Mud Saver Valve II, at any well bore depth, is only a function of the mechanical compression spring pre load and whatever pressure is required to overcome the friction of the piston seals.

In the new Mud Saver Valve II design the amount of friction of the piston seals can be dramatically reduced by converting to mechanical labyrinth type seal. Labyrinth seals have no physical contact between the sealing surfaces. As a consequence of this the friction of the seal is eliminated. However, a small amount of leakage will pass through the seal. The amount of fluid following through the valve can be 12 barrels per min. (504 gal./min (1908 liters/min)). The small amount of leakage past the two (2) 0.625 inch (1.59 cm) diameter pistons is thought to be negligible.

Figure 13:
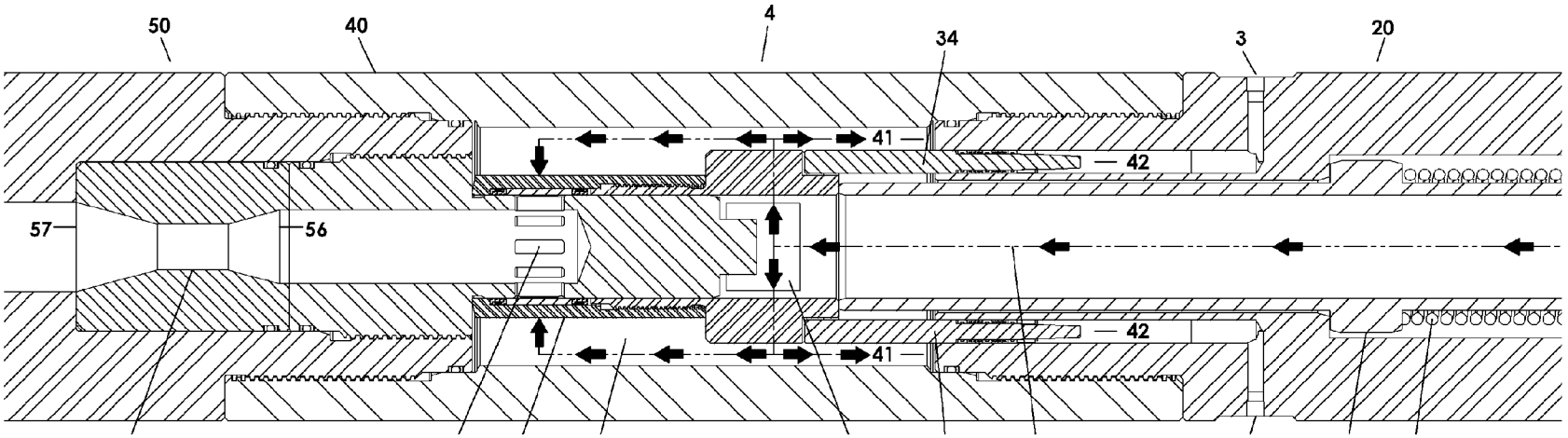
FIG. 13 is a front section view of the preferred embodiment of the apparatus of the present invention in the closed position.

Turning now the drawing Figures, first FIG. 13 illustrates the new Mud Saver Valve II in the closed position. Spring 24 is the closing compression spring that is preloaded at assembly and pushes against a spring closing sleeve 23 which ultimately pushes against valve actuator-sliding sleeve (open/close) 32 and closes the valve.

The annulus pressure is fed through annulus pressure feed port 3 to the closing side of valve actuator-piston 34 at valve actuator-piston close valve pressure side 42.

The pressure inside the drill string or pipe 17 which with the same weight fluid in the pipe 17 and annulus is equal to the annulus pressure is fed down inlet fluid conductor 6 to the valve actuator radial port through valve actuator radial port 7 and into inlet fluid cavity between the valve actuator housing and the valve actuator sliding sleeve 8, where it is blocked by sliding sleeve 32 and fed to valve actuator-piston open valve pressure side 41. Since the annulus and pipe pressure are equal the differential pressure across the pistons 34 is zero and the springs 24 pre load holds the valve closed.

Figure 14:
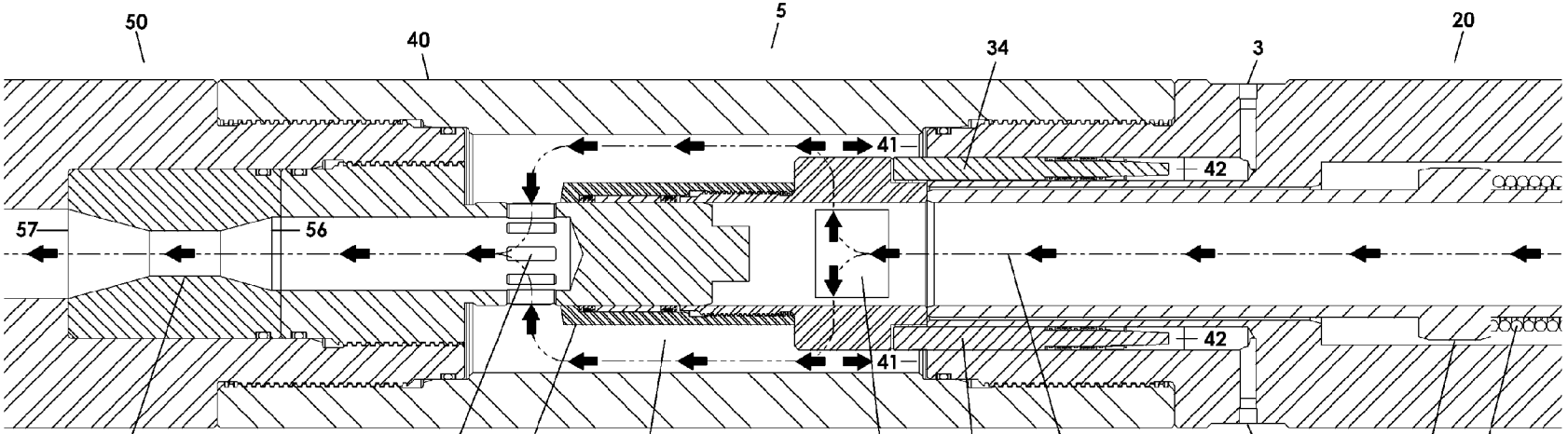
FIG. 14 is a front section view of the preferred embodiment of the apparatus of the present invention in the open position.
Figure 15:
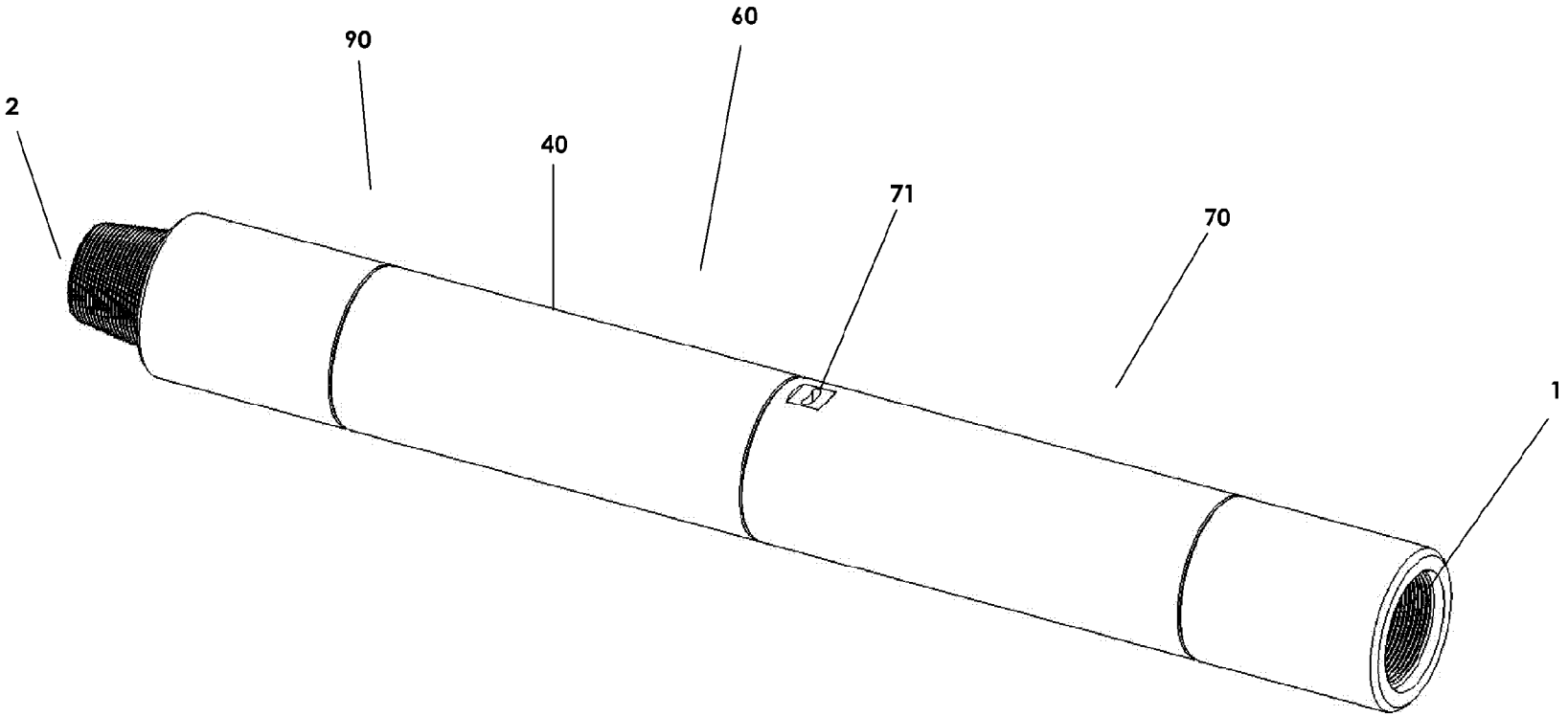
FIG. 15 illustrates an isometric view of an alternate embodiment of the Mud Saver Valve II of the present invention.
Figure 16:
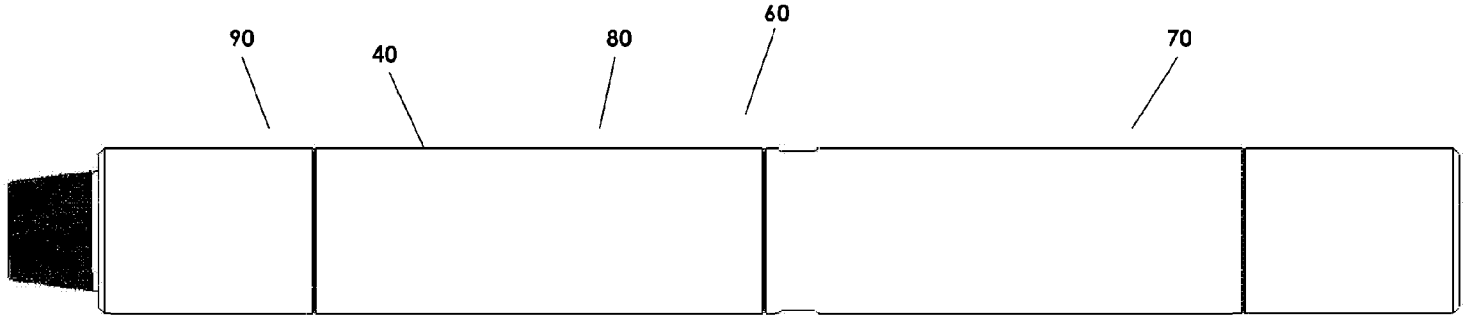
FIG. 16 illustrates a front view of an alternate embodiment of the Mud Saver Valve II of the present invention.

FIG. 14 illustrates the new Mud Saver Valve II in the open position. Fluid is shown flowing through the valve. At the moment when the mud pumps are turned on and sliding sleeve 32 is in the closed position, as shown in FIG. 13, pressure builds quickly at valve actuator 41 which moves inlet fluid piston 34 to the open position. Fluid flows down inlet fluid conductor 6 and then through valve actuator radial port 7 where it enters inlet fluid cavity between the valve actuator housing and the valve actuator sliding sleeve 8 before flowing through cage radial inlet ports 55 and entering the orifice inlet 56. The flow across the orifice 52 creates a pressure differential across the orifice item 52. For all practical purposes the pressure differential across the orifice 52 is approximately equal to the pressure differential across the piston 34. The pressure at orifice inlet 56 is approximately equal to the pressure at actuator-actuator-piston open 41. The pressure at orifice outlet 57 is approximately equal to the pressure at valve actuator-piston close 42. Practically, the orifice can be considered to be anything from valve actuator-piston open 41 through the drill bit 83 that creates any pressure drop (restrictions). High flow rates with high pressure drop will insure that the valve stays completely open. If the flow rate drops the valve will throttle itself working the pressure differential across the piston 34 against the spring preload 24.

From Alternate Embodiment Operation

Recent testing of the Mud Saver Valve II, as represented in FIGS. 1-14 performed as expected. At a very low flow rate (less than 1 gal/min (3.78 liters/min)) the Mud Saver Valve II cracked open at the correct pressure and then repeatedly closed and re-cracked open as expected. However, there are a couple of points which we would like to cover as an alternate embodiment of the Mud Saver Valve II and represented in FIGS. 15-23.

Figure 26:
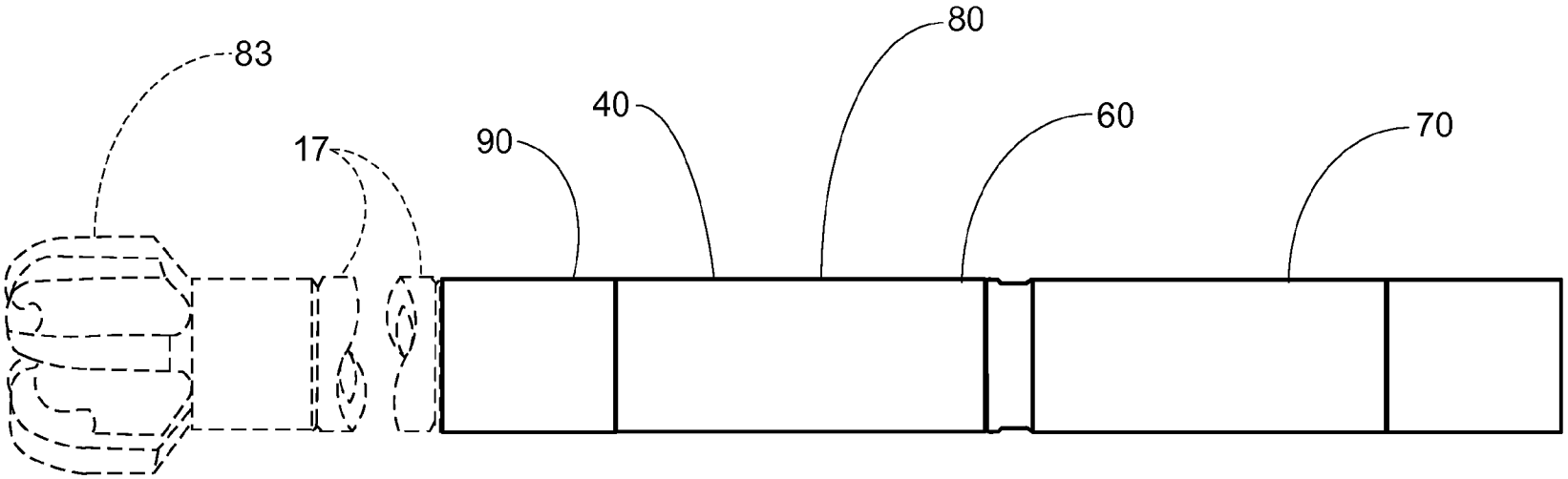
FIG. 26 illustrates an alternate embodiment of the mud saver valve II of the present invention with the drill bit and drill string or pipe shown in phantom view.

FIGS. 15-17 and 26 illustrate an alternate embodiment 60 of the Mud Saver Valve II. A box end pre-sub assembly 70, and annulus pressure feed port 71 which is kidney shaped, are shown. FIG. 18 illustrates the major sub assemblies, including the box and pre-sub assembly 70, valve components 80, 90, and valve actuator housing 40. FIG. 26, shows the alternate embodiment of the Mud Saver Valve II, positioned on the drill string or pipe 17, just above drill bit 83.

The first area of interest is the two (2) small pistons represented in FIGS. 1-14. There is no guarantee that both small pistons will function in the exact same way. If one piston should hang up, for what ever reason, it may cause the valve to cock and stick. Also, the cross sectional area of the two (2) pistons is very small and therefore requires a fairly high cracking pressure even though the closing spring pre load force is relatively low at 600 pounds (272 kg). The high crack pressure is wasted pressure that gets added to the pump pressure requirements as the valve is throttled between the fully closed and fully opened positions.

Figure 17:
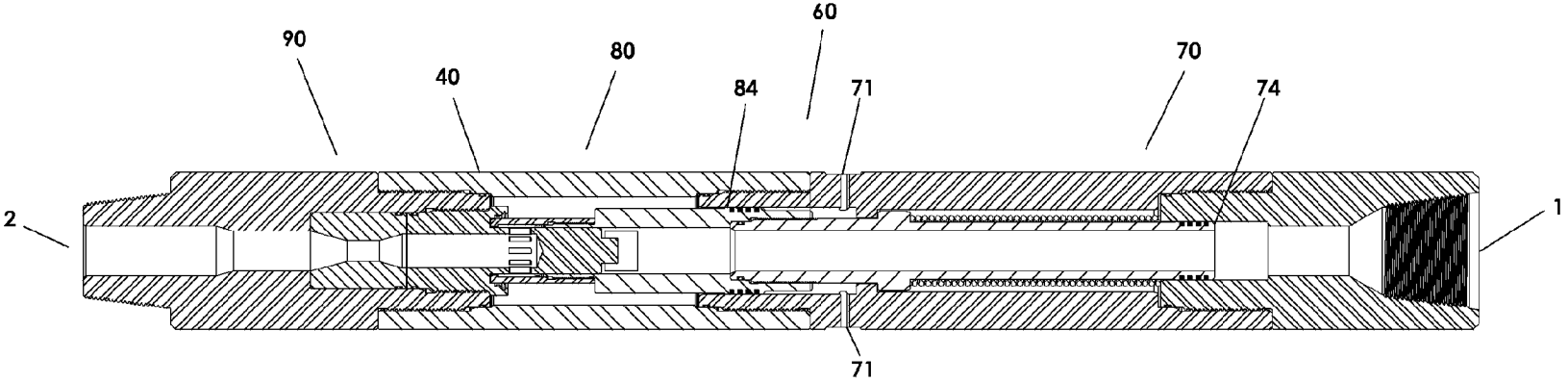
FIG. 17 illustrates a front section view in the close of the alternate embodiment of the Mud Saver Valve II in the closed position.
Figure 18:
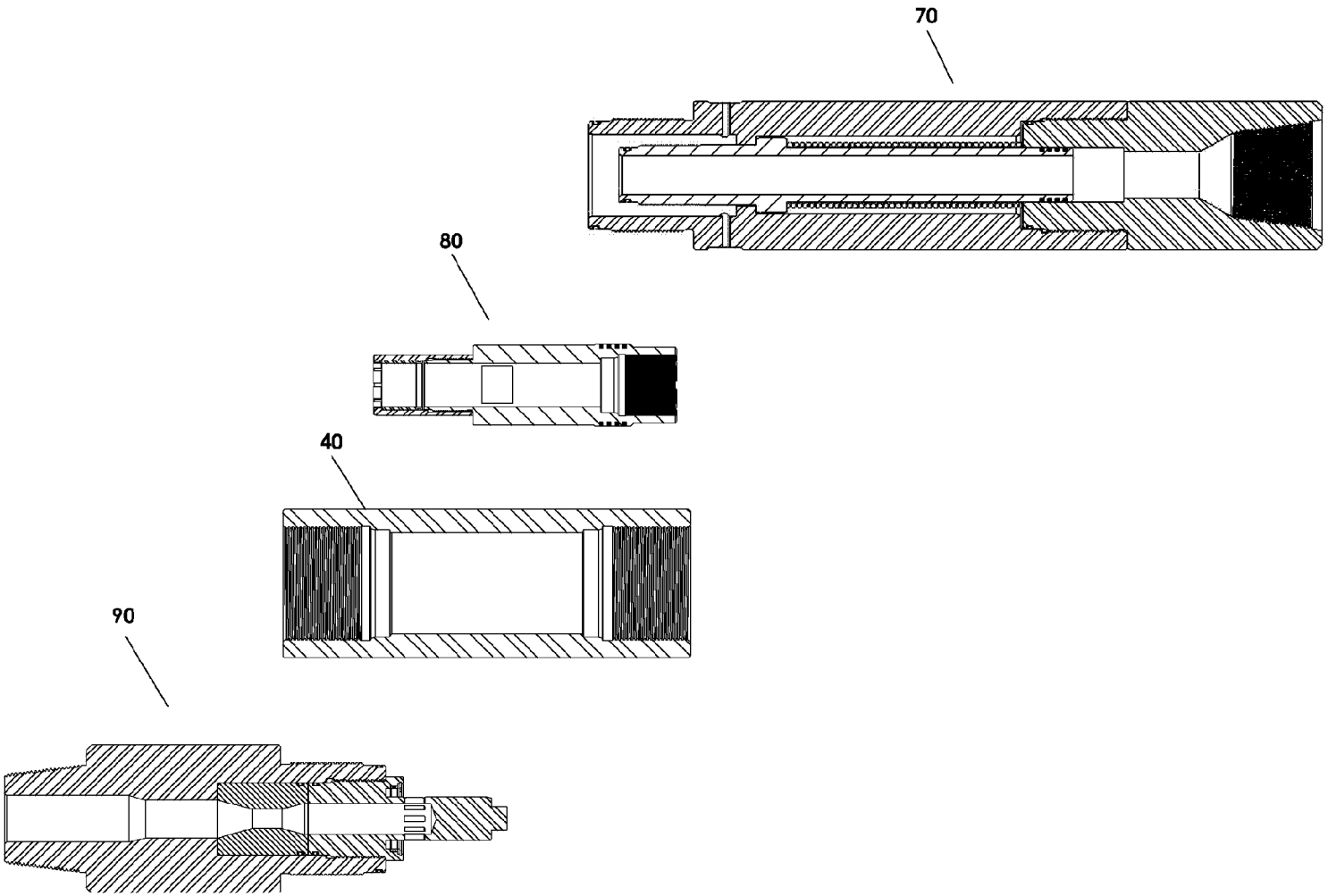
FIG. 18 illustrates a front section view of an alternate embodiment of the Mud Saver Valve II illustrating the major sub assemblies.
Figure 19:
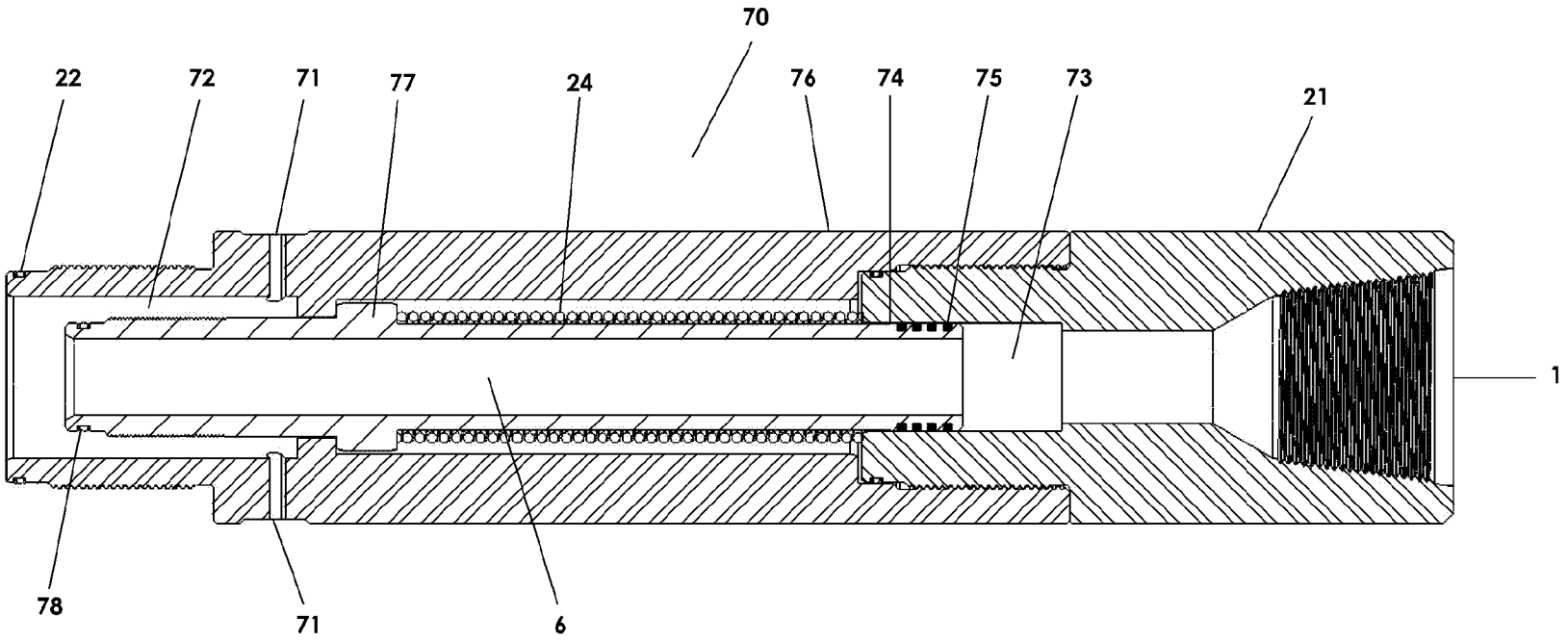
FIG. 19 illustrates a front section view of the alternate boxed end sub pre assembly of the Mud Saver Valve II of the present invention.

Piston 74, 84 of FIG. 17. In the alternate embodiment the two (2) small pistons that were positioned radially offset from the center axis of the valve are replaced with these two (2) much larger piston that are positioned concentrically with the center axis of the valve and each other. The new pistons are also concentric with other important valve components such as reference 80, 90, shown more clearly in FIG. 18.

This design represented in FIG. 17 will allow for a much lower cracking pressure and much higher spring pre load closing force. Also if cast iron piston seal or Teflon split piston seals are used they will provide very low friction forces and high ware resistance. However these seals will allow a very small amount of fluid to leak past them.

Figure 6:
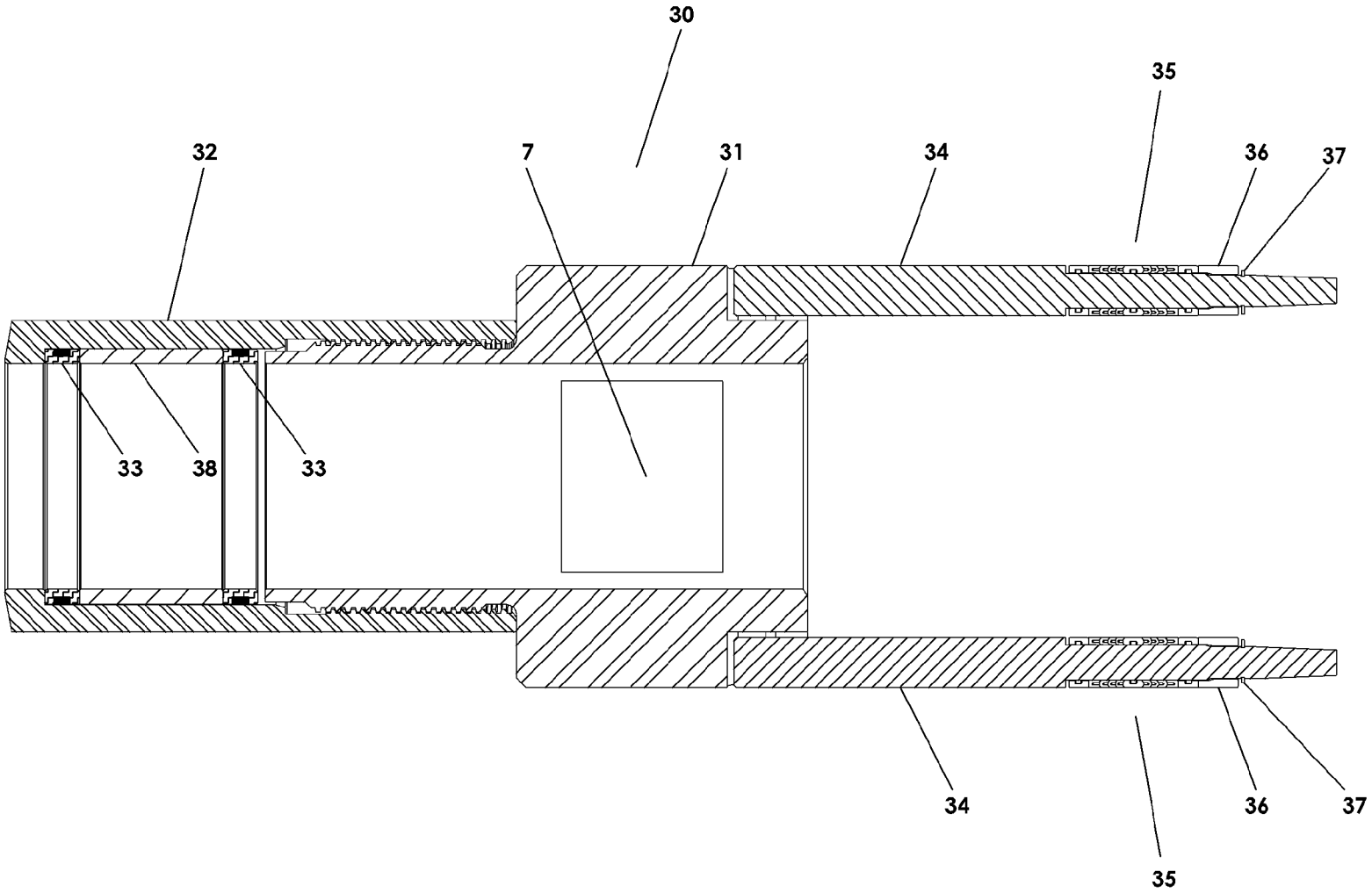
FIG. 6 is a front section view of the preferred embodiment of the apparatus of the present invention.
Figure 7:
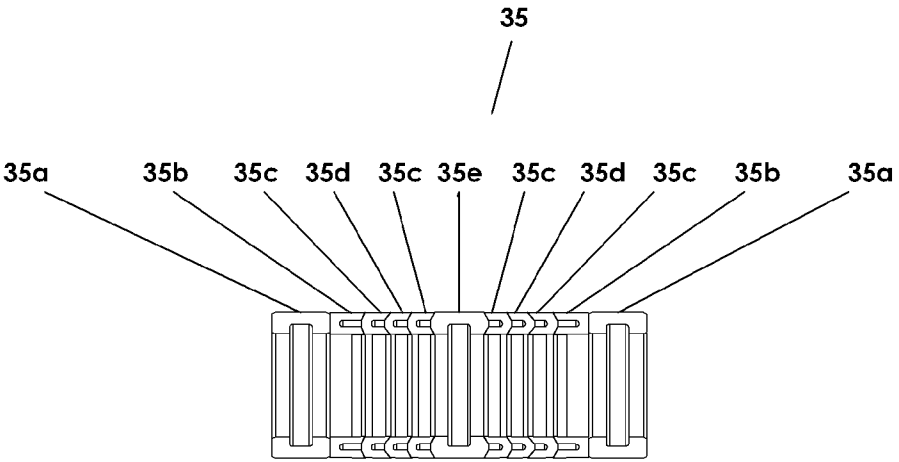
FIG. 7 is a front section view—Valve Actuator Piston—Seal Assembly
Figure 10:
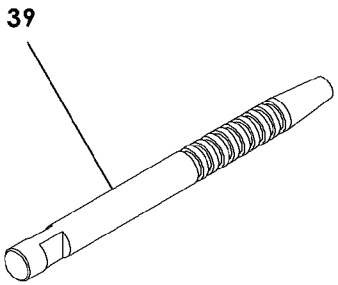
FIG. 10 is an isometric view of the preferred embodiment of the apparatus of the present invention.
Figure 8:
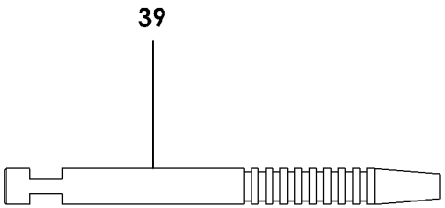
FIG. 8 is a top view of the preferred embodiment of the apparatus of the present invention.
Figure 9:
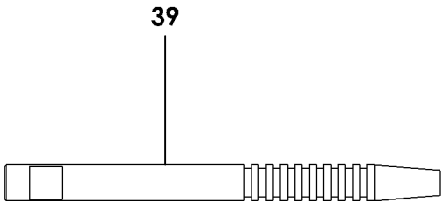
FIG. 9 is a front view of the preferred embodiment of the apparatus of the present invention.
Figure 11:
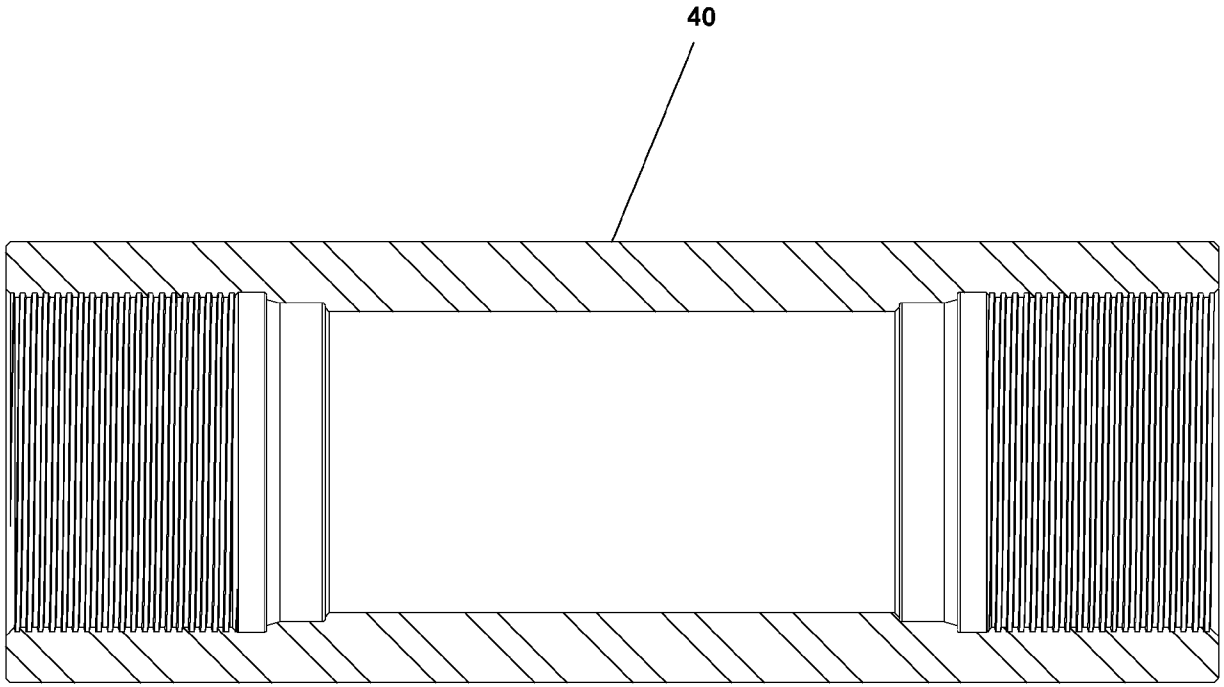
FIG. 11 is a front section view of the preferred embodiment of the apparatus of the present invention.
Figure 12:
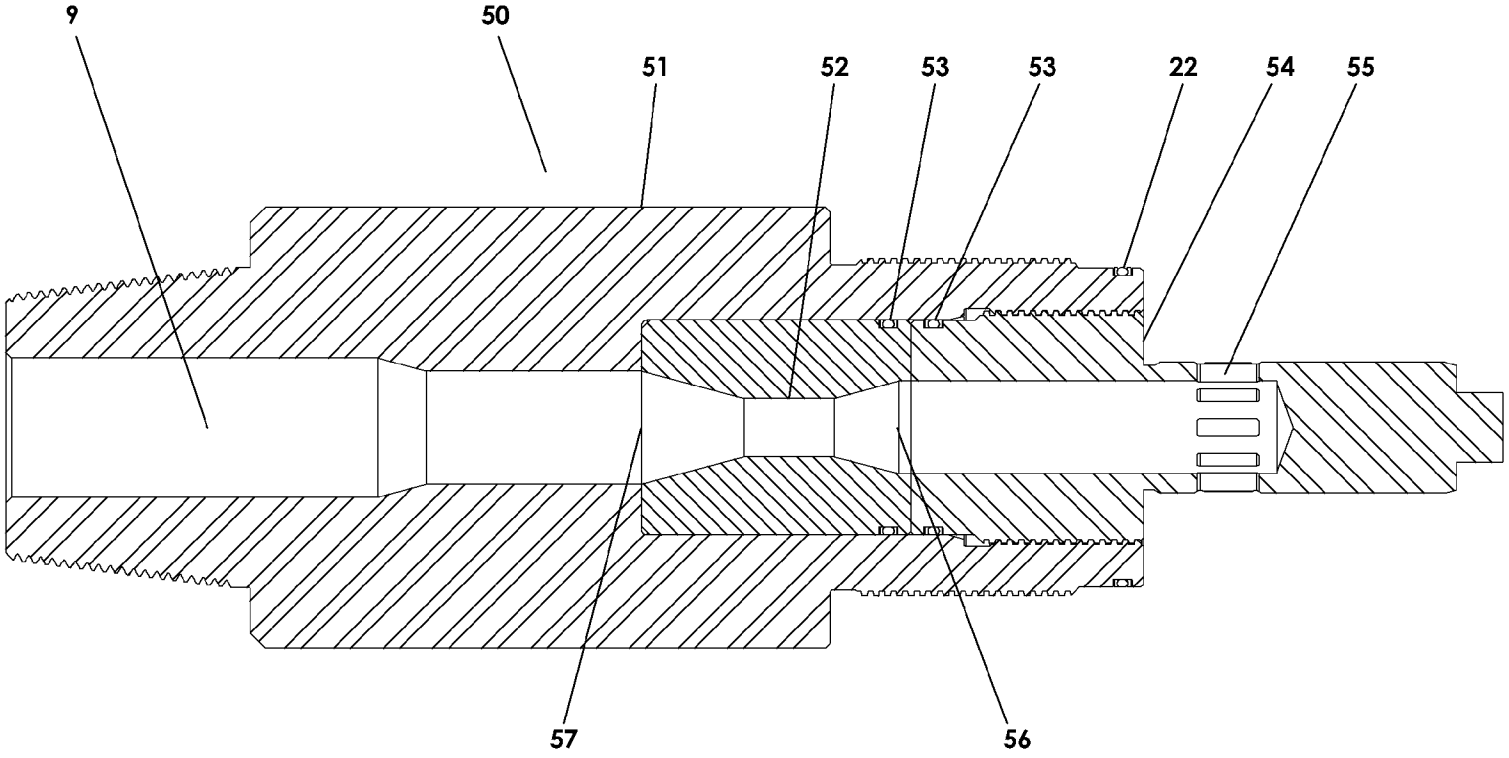
FIG. 12 is a front section view of the preferred embodiment of the apparatus of the present invention.

The second area of interest is the Pin End (bottom) Sliding Sleeve Seal represented as sliding sleeve main seal 33 of FIG. 6. Reference is made to FIG. 13 and FIG. 14 showing the valve in the closed and open position. Notice that as the valve opens the Pin End (bottom) Sliding Sleeve Seal must pass over the radial ports in the cage represented as cage radial inlet ports 55 of FIG. 14. Also notice that the Box End (top) Sliding Sleeve Seal is Ok as it never passes over the radial ports.

The Pin End (bottom) Sliding Sleeve Seal may be cut or otherwise damaged as it passes over the radial ports. The relatively low closing force of the spring may not allow the valve to close if part of the damaged seal gets caught up in the Sliding Sleeve mechanism.

In the alternate embodiment the Pin End (bottom) Sliding Sleeve Seal is made larger in diameter and moved to an alternate embodiment of the Cage. Reference FIG. 21, reference 93, alternate Cage (Plunger Type), represents the new larger Sliding Sleeve Seal, reference 91 of FIG. 21 and the snap ring and back up washer, reference 92 of FIG. 21, that is used to hold the seal in place.

Figure 20:
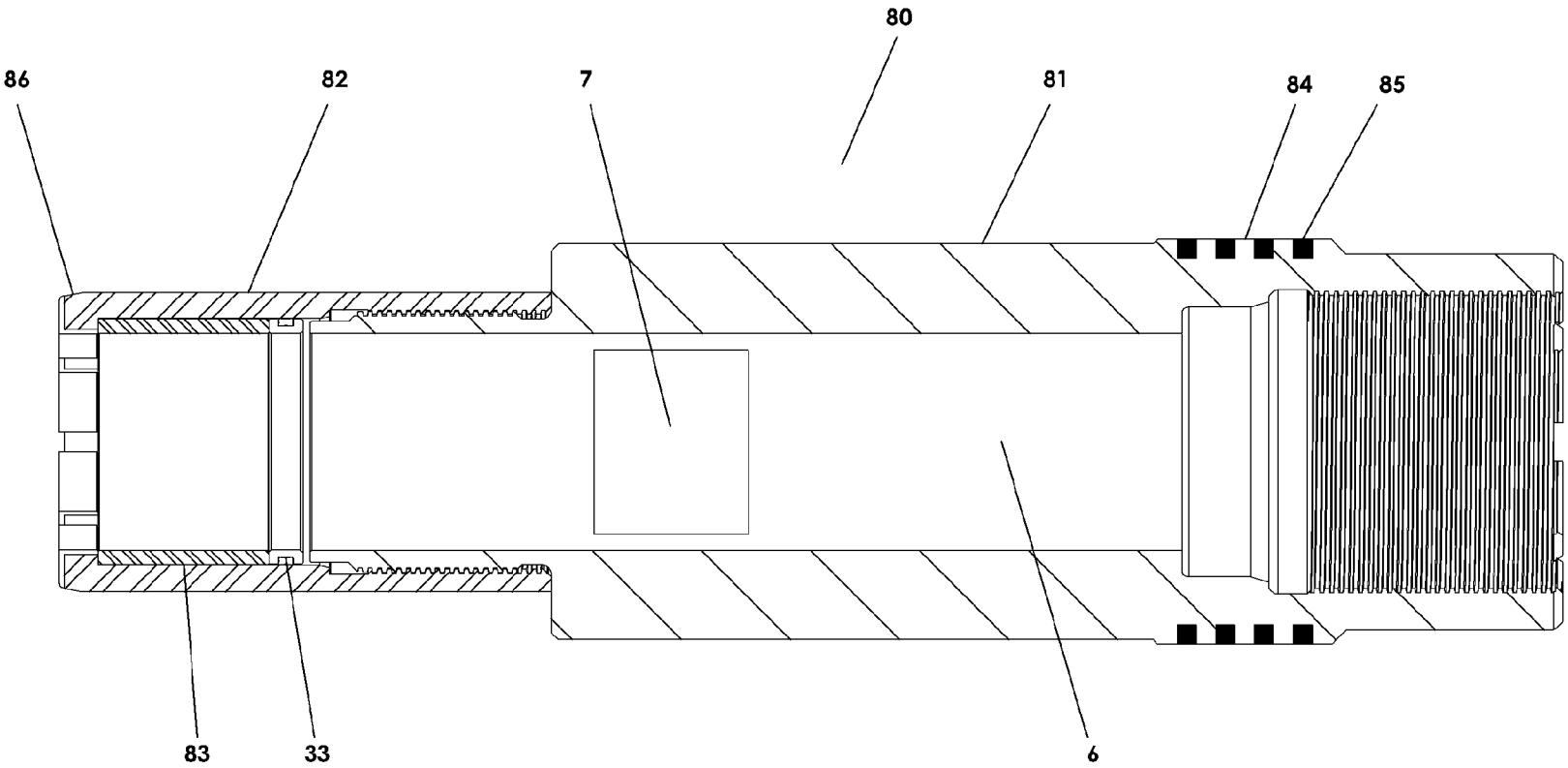
FIG. 20 illustrates a front section view of an alternate valve actuator pre assembly of the Mud Saver Valve II of the present invention.
Figure 21:
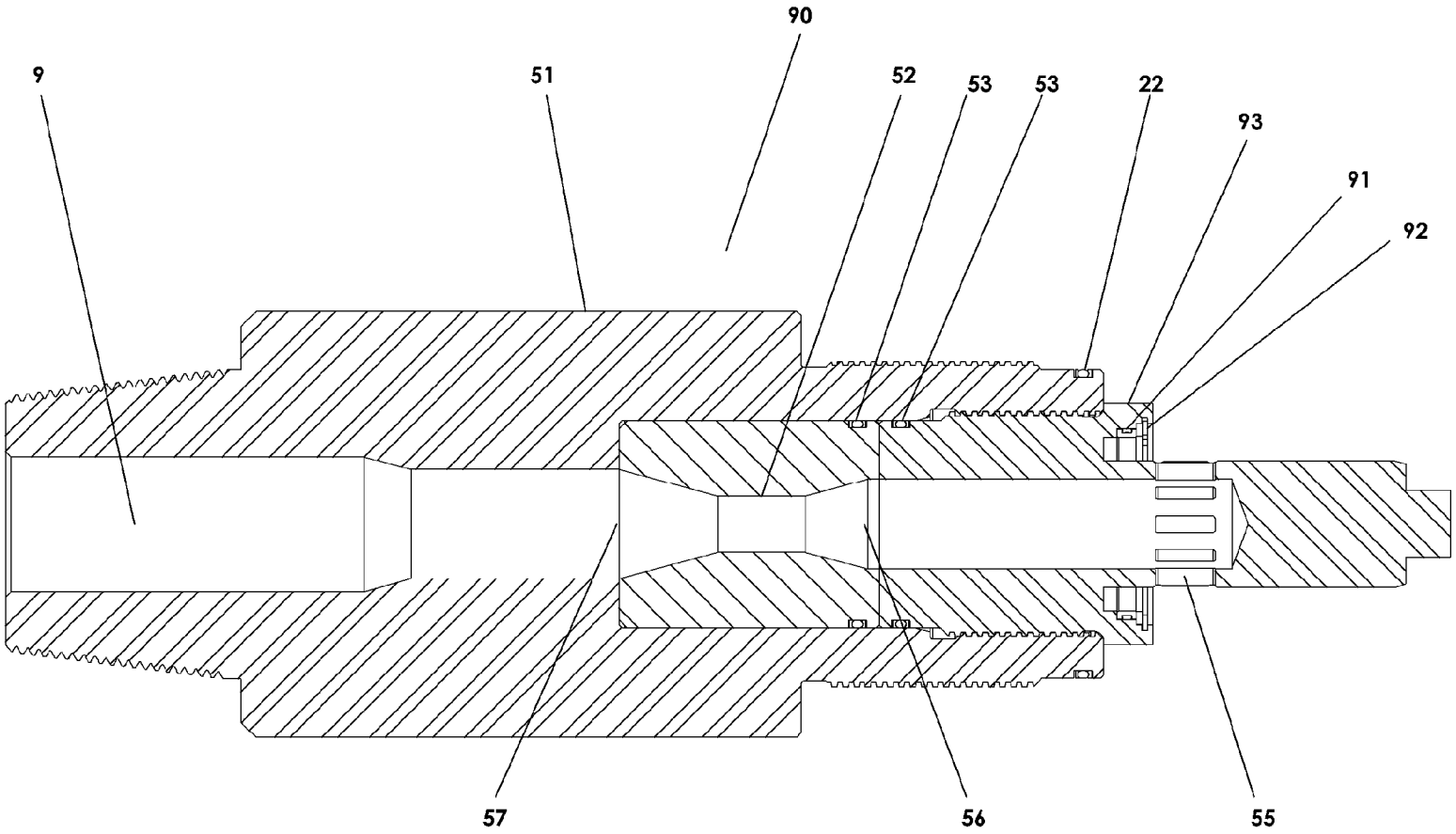
FIG. 21 illustrates a front section view of the alternate pin end sub pre assembly of the Mud Saver Valve II of the present invention.

The new alternate embodiment of the Sliding Sleeve, alternate valve actuator-sliding sleeve (Open/close) 82 of FIG. 20 has a very gradual tapered nose which is designed to function as a plunger that slides in under the new larger seal, Reference 91 of FIG. 21.

Figure 22:
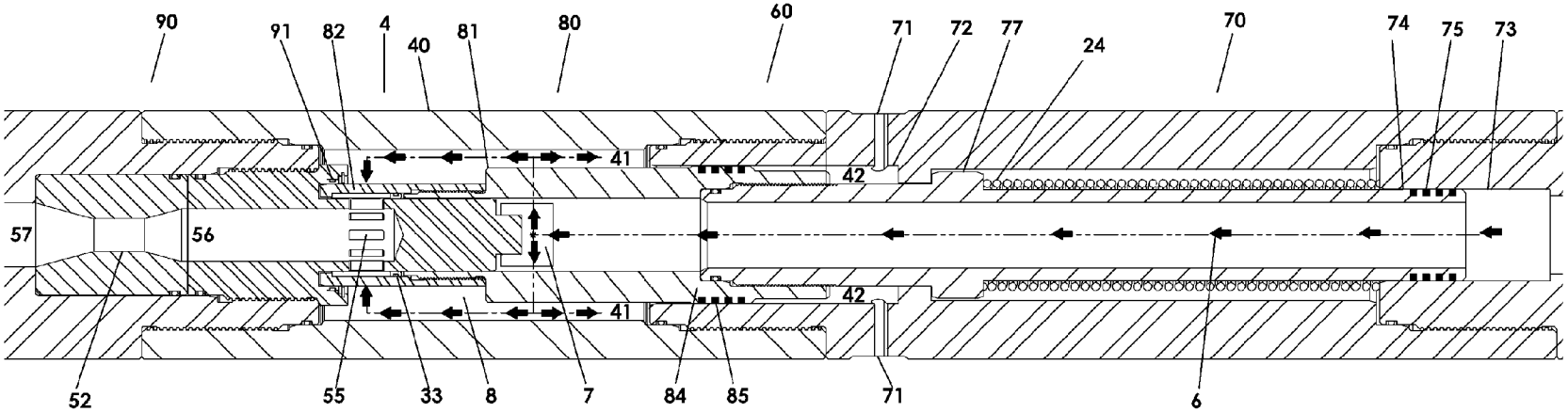
FIG. 22 illustrates a front section view (cut) of the Mud Saver Valve II of the present invention in the closed position.

FIG. 22 shows the new Mud Saver Valve w/Concentric Pistons in the closed position. Spring 24 is the closing compression spring that is pre loaded at assembly and pushes against alternate Spring Closing Sleeve 77 which ultimately pushes against alternate valve actuator-sliding sleeve (Open/close) 82 and closes the valve.

The annulus pressure is fed through Alternate Annulus Pressure Feed Port-Kidney Shaped 71 at Valve Actuator-Piston Close Valve Pressure Side 42.

The pressure inside the pipe which with the same weight per unit volume of fluid in the pipe and annulus is equal to the annulus pressure is fed down Inlet Fluid Conductor 6 to the Valve Actuator Radial Port 7 and into Inlet Fluid Cavity 8 between the Valve Actuator Housing 40 and the Valve Actuator Sliding Sleeve 82 where it is blocked by alternate valve actuator-sliding sleeve (open/close) 82 and fed to Valve Actuator-Piston Open Valve Pressure Side 41.

Since the mud pumps are turned off and the fluid in the pipe has the same weight per unit volume as the fluid in the annulus then the pipe and annulus pressures are equal and the differential pressure across the pistons 84, 74 is zero and the pre load force of the spring 24 holds the valve closed.

Figure 23:
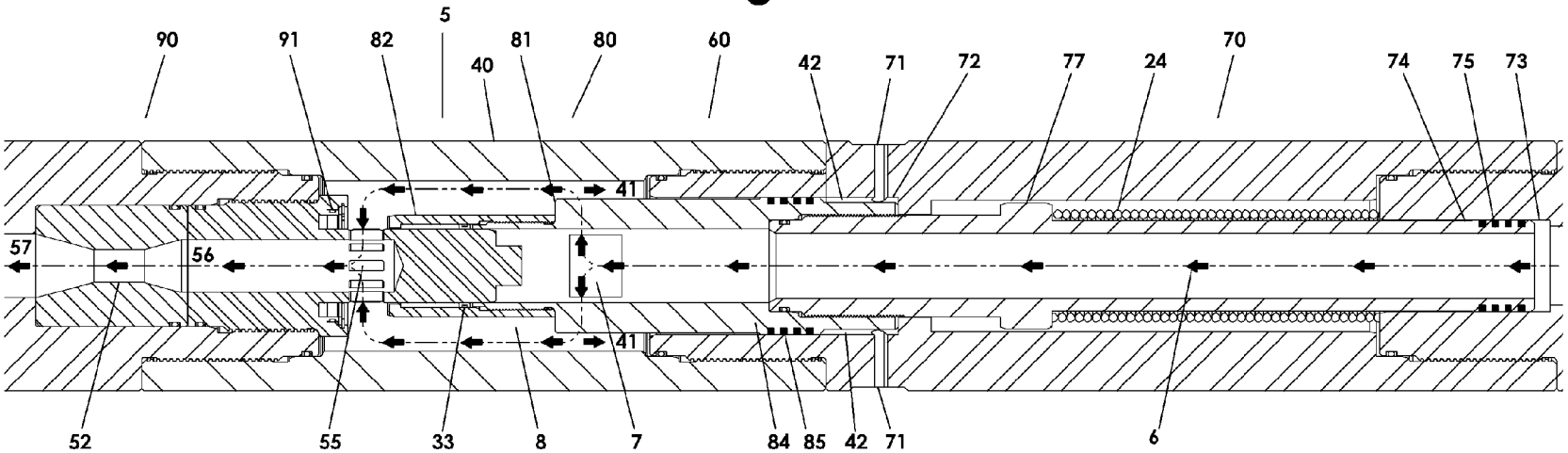
FIG. 23 illustrates a front section view (cut) of the Mud Saver Valve II in the open position.

FIG. 23 shows the new Mud Saver Valve with Concentric Pistons in the open position. At the moment the mud pumps are turned on the fluid in the pipe is blocked from flowing by sliding sleeve 82 shown in the closed position in FIG. 22. Very quickly pressure builds at valve actuator 41. When the pressure at valve actuator 41 rises high enough above the annulus pressure at valve actuator 42 to over come the spring per load force provided by spring 24 the pistons 84, 74 will move together to open a fluid pathway through the valve.

Fluid flows down inlet fluid conductor 6 and then through the radial ports 7 where the fluid then enters inlet fluid cavity 8 before flowing through Cage Radial Ports 55 and entering The Orifice Inlet 56. The flow across Fixed Orifice 52 creates a pressure differential across Fixed Orifice 52. For all practical purposes the pressure differential across fixed orifice 52 is approximately equal to the pressure differential across pistons 84, 74. The pressure at Orifice Inlet 56 is approximately equal to the pressure at valve actuator-piston open 41 and the pressure at Orifice Outlet 57 is approximately equal to the pressure at valve actuator-piston close 42.

Practically the Orifice can be considered to be anything from valve actuator-piston open 41 through the drill bit 83 that creates any pressure drop (restriction). High flow rates with high pressure drops will insure that the valve stays completely open. If the flow rate drops the valve will throttle itself working the pressure differential across the pistons 84, 74 against the spring preload of spring 24.

Figure 24:
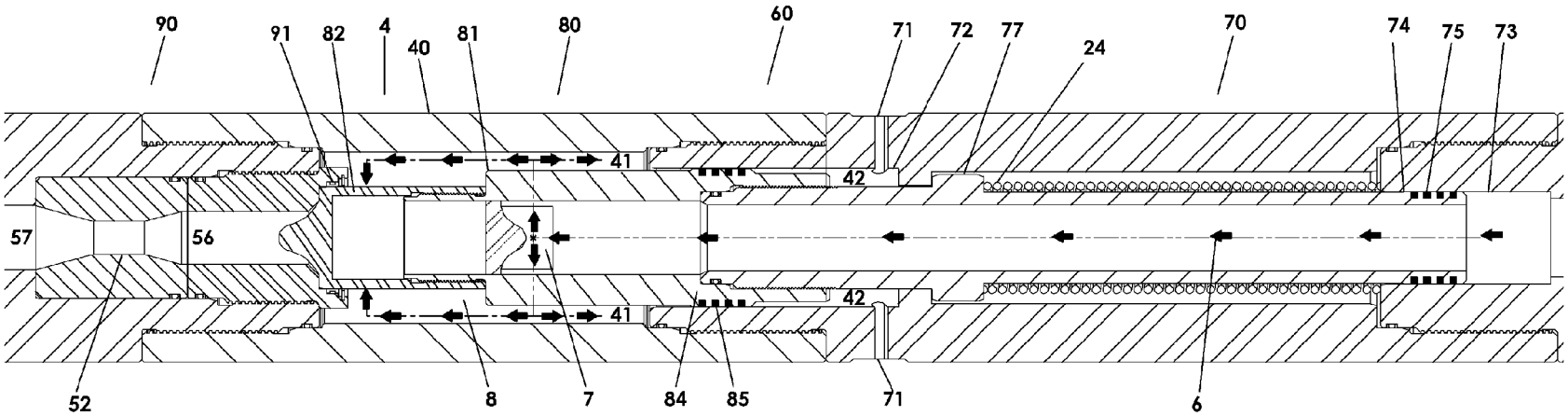
FIGS. 24 and 25 illustrate modified embodiments of the Mud Saver Valve II of the present invention from that shown in FIGS. 22 and 23.
Figure 25:
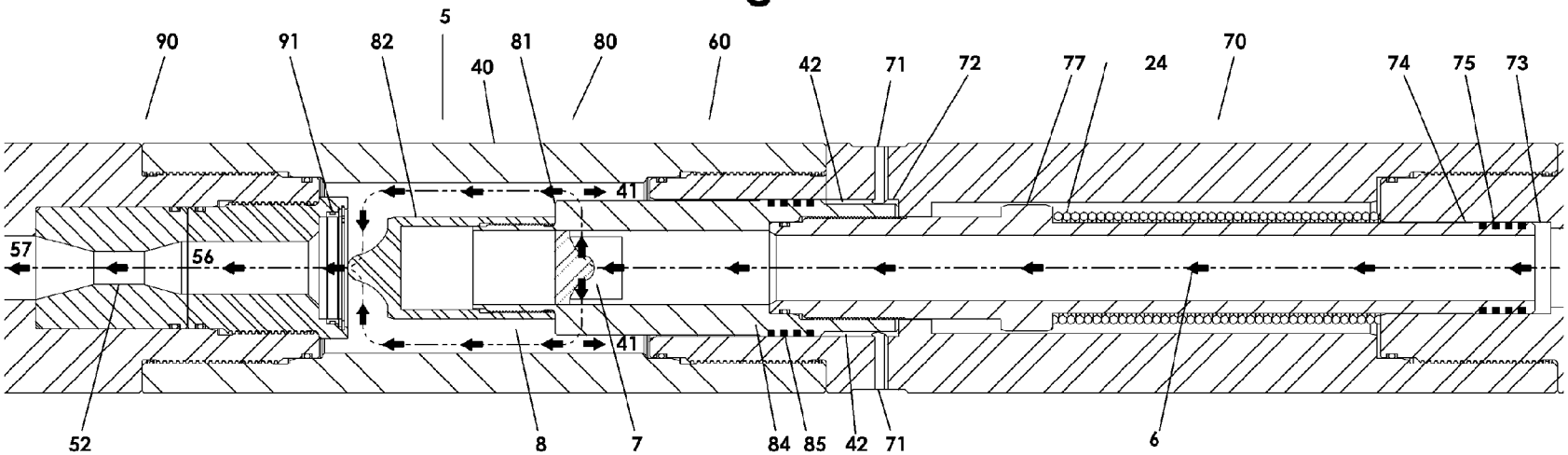

FIGS. 24 and 25 illustrate an alternative embodiment of the valve 60 as that shown in FIGS. 22 and 23 as discussed above. To allow for greater flow capacity, in this embodiment, the cage radial inlet ports 55 are being removed and there are installed fluid guide noses to help the fluid flow entering and leaving inlet fluid cavity 8 between the valve actuator housing and the valve actuator sliding sleeve. The valve actuator-sliding sleeve main seal 33 is also removed. The seal 91 can represent metal to metal conical sealing surfaces, and a vertical face type seal could be employed.

Finally, if the fluid in the drill string or pipe 17 and the fluid in the annulus have the same weight per unit volume then the cracking pressure of the valve at any depth is equal to the cracking pressure of the valve at sea level. Therefore, there is no longer a concern about the valve opening because the hydrostatic pressure due the tool's depth and the weight of the fluid per unit volume in the pipe exceeded the spring cracking pressure.

The following is a list of parts and materials suitable for use in the present invention.

PARTS LIST

| Part Number | Description |
|---|---|
| 1 | inlet fluid port at box |
| 2 | outlet fluid port at pin |
| 3 | annulus pressure feed port |
| 4 | mud saver valve II (closed position) |
| 5 | mud saver valve II (open position) |
| 6 | inlet fluid conductor to the valve actuator radial port |
| 7 | valve actuator radial port |
| 8 | inlet fluid cavity between the valve actuator housing and the valve actuator sliding sleeve |
| 9 | outlet fluid flow conductor |
| 10 | mud saver valve II - final assembly |
| 17 | drill string/pipe |
| 20 | box end sub pre assembly |
| 21 | box end adaptor |
| 22 | static seal - a |
| 23 | spring closing sleeve |
| 24 | spring |
| 25 | valve actuator piston honed and polished bore |
| 30 | valve actuator pre assembly |
| 31 | valve actuator - upper cage |
| 32 | valve actuator - sliding sleeve (open/close) |
| 33 | valve actuator - sliding sleeve main seal |
| 34 | valve actuator - piston |
| 35 | valve actuator - piston seal assembly |
| 35a | valve actuator - piston seal end |
| 35b | valve actuator - piston seal female back up |
| 35c | valve actuator - piston seal 'v' ring - a |
| 35d | valve actuator - piston seal 'v' ring - b |
| 35e | valve actuator - piston seal center spacer |
| 36 | valve actuator - packing header ring |
| 37 | valve actuator - snap ring |
| 38 | valve actuator - sliding sleeve main seals spacer |
| 39 | valve actuator - optional piston w/labyrinth groove seal |
| 40 | valve actuator housing |
| 41 | valve actuator - piston open valve pressure side |
| 42 | valve actuator - piston close valve pressure side |
| 50 | pin end sub pre assembly |
| 51 | pin end adaptor |
| 52 | fixed orifice |
| 53 | static seal b |
| 54 | cage |
| 55 | cage radial inlet ports |
| 56 | orifice inlet |
| 57 | orifice outlet orifice outlet |
| 60 | alternate mud saver valve II |
| 70 | alternate box end sub pre assembly |
| 71 | alternate annulus pressure feed port-kidney shaped |
| 74, 84 | pistons |
| 77 | alternate spring closing sleeve |
| 80, 90 | valve components |
| 82 | alternate valve actuator-sliding sleeve (open/close) |
| 83 | drill bit |
| 91 | seal |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A mud saver valve, positionable at the bottom of a drill string, above a bit, which comprises:

a. an elongated body portion;

b. a pressure portion housing a compressible spring;

c. a valve mechanism positioned within the valve;

d. while in the closed position, drilling fluid cannot pass through the valve;

e. when a combination of static and pump pressure exceeds the setting pressure of the spring, a sleeve will be moved by actuation pistons to the open position, at which drilling fluid is allowed to flow through the valve; and f. wherein by opening a closing side of the actuation pistons to annulus pressure at any mud saver valve location, the valve's cracking pressure becomes independent of the depth of the tool in a hole.

2. The valve in claim 1, wherein the valve mechanism comprises a sliding sleeve moveable between the open and closed positions within the valve.

3. The valve in claim 2, wherein the sleeve is moved to the open position by means of the actuation pistons.

4. The valve in claim 1, wherein as long as the spring pressure is greater than the setting pressure, the valve remains in the closed position to allow the drill string to be disconnected, so that a section of pipe can added without the fluid draining from the drill column above the bit, resulting in a saving of fluid.

5. A mud saver valve, positionable at the bottom of a drill string, above a bit, which comprises:

a. an elongated body portion;

b. a pressure portion housing a compressible member, such as a coiled spring;

c. a valve mechanism which comprises a sliding sleeve moveable between open and closed positions within the valve;

d. while in the closed position, drilling fluid cannot pass through the valve;

e. when a combination of static and pump pressure exceeds the setting pressure of the compressible member, the sleeve will be moved by actuation pistons to the open position, at which drilling fluid is allowed to through the valve; and f. wherein by opening a closing side of the actuation pistons to annulus pressure, the valve's cracking pressure becomes independent of the depth of the tool in a hole.

6. The valve in claim 2, wherein the sleeve is moved to the open position by means of actuation pistons.

7. The valve in claim 5, wherein the sleeve is moved to the open position by means of the actuation pistons.

8. A mud saver valve, positionable beneath the surface of the water at the bottom of a drill string, above a bit, which comprises:

a. an elongated body portion;

b. a pressure portion housing a compressible spring;

c. a valve mechanism, further comprising a sliding sleeve moveable between open and closed positions within the valve;

d. while the sleeve is in the closed position, drilling fluid cannot pass through the valve; and e. when a combination of static and pump pressure exceeds the setting pressure of the spring, the sleeve will be moved by actuation pistons to the open position, at which drilling fluid is allowed to flow through the valve.

* * * * *